US008933851B2

(12) United States Patent
Matthews et al.

(10) Patent No.: US 8,933,851 B2
(45) Date of Patent: Jan. 13, 2015

(54) BODY WEARABLE ANTENNA

(75) Inventors: James Christopher Gordon Matthews, Bury St Edmunds (GB); Paul James Tittensor, Chelmsford (GB)

(73) Assignee: BAE SYSTEMS plc, London (GB)

( * ) Notice: Subject to any disclaimer, the term of this patent is extended or adjusted under 35 U.S.C. 154(b) by 222 days.

(21) Appl. No.: 13/575,698

(22) PCT Filed: Jan. 11, 2011

(86) PCT No.: PCT/GB2011/050032
§ 371 (c)(1),
(2), (4) Date: Jul. 27, 2012

(87) PCT Pub. No.: WO2011/092485
PCT Pub. Date: Aug. 4, 2011

(65) Prior Publication Data

US 2012/0293382 A1 Nov. 22, 2012

(30) Foreign Application Priority Data

Jan. 27, 2010 (EP) ..... 10275008
Jan. 27, 2010 (GB) ..... 1001309.2

(51) Int. Cl.
*H01Q 1/12* (2006.01)
*H01Q 1/27* (2006.01)

(52) U.S. Cl.
CPC . *H01Q 1/27* (2013.01); *H01Q 1/273* (2013.01)
USPC ..... 343/718; 343/702

(58) Field of Classification Search
CPC ..... H01Q 1/27; H01Q 1/273
USPC ..... 343/718, 702, 893
See application file for complete search history.

(56) References Cited

U.S. PATENT DOCUMENTS 4,041,394 A 8/1977 Pate
5,148,002 A * 9/1992 Kuo et al. ..... 219/211

(Continued)

FOREIGN PATENT DOCUMENTS

GB 2 183 099 A 5/1987
GB 2 455 910 7/2009

(Continued)

OTHER PUBLICATIONS

International Preliminary Report on Patentability and Written Opinion, dated Aug. 9, 2012 from related International Application No. PCT/GB2011/050032.
International Search Report dated Apr. 6, 2011 issued in PCT/GB2011/050032.
Extended European Search Report dated Jul. 23, 2010 issued in EP 10275008.0.
UK Search Report dated May 11, 2010 issued in GB1001309.2.

* cited by examiner

*Primary Examiner* — Hoanganh Le
(74) *Attorney, Agent, or Firm* — Scully, Scott, Murphy & Presser, PC

(57) ABSTRACT

A body wearable antenna adapted to be worn against the body, comprising: a first antenna part (4); and a second antenna part (6) insulated from the first part (4); wherein the first antenna part (4) is adapted to be worn circumferentially around a body part (100); and the second antenna part (6) is adapted to be worn longitudinally against a body part (100). The body parts that the first antenna part (4) is adapted to be worn around and that the second antenna part (6) is adapted to be worn against maybe the same. The second antenna part (6) may extend circumferentially around the body part (100) to some extent and may extend along substantially the whole length of the body part (100). The second antenna part (6) may comprise a plurality of radial elements (61, 62, 63) that extend away from the first antenna part (4).

14 Claims, 6 Drawing Sheets

(56) References Cited

U.S. PATENT DOCUMENTS

| | | | | |
|---|---|---|---|---|
| 6,356,238 | B1 * | 3/2002 | Gainor et al. | 343/718 |
| 6,972,725 | B1 | 12/2005 | Adams | |
| 7,002,526 | B1 | 2/2006 | Adams et al. | |
| 7,969,369 | B2 * | 6/2011 | Wertman et al. | 343/718 |
| 2004/0140939 | A1 | 7/2004 | Haller et al. | |
| 2006/0022882 | A1 * | 2/2006 | Gerder et al. | 343/718 |
| 2009/0134226 | A1 | 5/2009 | Stobbe | |
| 2009/0160716 | A1 * | 6/2009 | Rhodes et al. | 343/718 |

FOREIGN PATENT DOCUMENTS

| | | | |
|---|---|---|---|
| WO | WO 01/59877 | A1 | 8/2001 |
| WO | WO 2009/104617 | A1 | 8/2009 |

BODY WEARABLE ANTENNA

FIELD OF THE INVENTION

The present invention relates to body wearable antennas. In particular, the present invention relates to wideband body wearable antennas.

BACKGROUND

Body wearable antennas, and antennas that are portable by a person, are known.

Conventional body wearable antennas only operate well in a narrow frequency band. Conventional body wearable antennas operate at frequencies from 500 MHz to 5 GHz which allows them to be physically small in construction and relatively simple to wear unobtrusively on the body. However, such high frequency bands tend to have a very limited range. Also, use of such high frequency bands tend to suffer low propagation in many situations in which body wearable antennas are used, for example operations in urban environments. Antennas designed to operate using such narrow frequency bands also tend to suffer from detuning effects, such as those caused by body movements.

Thus, there is a requirement for wideband, low frequency (i.e. below 500 MHz) body wearable antennas that alleviate the problems suffered by narrowband antennas whilst maintaining advantages of being lightweight, being able to be worn unobtrusively and comfortably on the body, and being structurally strong.

There is also a requirement, particularly in military applications, for a body wearable antenna that is relatively discrete, i.e. does not advertise the position of a user, and that does not hinder the wearer's ability to carry other equipment, for example body armour and ammunition.

SUMMARY OF THE INVENTION

In a first aspect, the present invention provides a body wearable antenna adapted to be worn against the body comprising: a first antenna part; and a second antenna part insulated from the first antenna part; wherein the first antenna part is adapted to be worn circumferentially around a body part; and the second antenna part is adapted to be worn longitudinally against a body part.

The body part that the first antenna part is adapted to be worn circumferentially around and the body part that the second antenna part is adapted to be worn longitudinally against may be different body parts The body part that the first antenna part is adapted to be worn circumferentially around and the body part that the second antenna part is adapted to be worn longitudinally against may be the same body part.

The second antenna part may extend circumferentially around the body part to some extent.

At least a part of the second antenna part may extend along substantially the whole length of the body part.

The second antenna part may comprise a plurality of radial elements, arranged such that each radial element extends away from the first antenna part.

Each of the plurality of radial elements may be oblique with respect to another of the plurality of radial elements.

The second antenna part may comprise three radial elements.

A first of the three radial elements may extend around a first side of the body part; a second of the three radial elements may extend around a second side of the body part; and the first side may be opposite the second side.

One or more radial elements may each comprise one or more hinges.

The first antenna part may be a band of material.

One or both of the body parts may be a leg of a user.

The body wearable antenna may be adapted to be worn on top of a user's clothes.

In a further aspect, the present invention provides a communications system comprising: a body wearable antenna according to any of the above aspects; a radio transceiver adapted to send and receive signals via the body wearable antenna; and a connector arranged to connect the body wearable antenna to the radio transceiver.

The radio transceiver may be portable.

DETAILED DESCRIPTION

The terminology "body wearable antenna" is used herein to refer to antennas that are adapted to be worn on or against a part of the human body by conforming to the contours of a human body part, for example a leg. Here the term "body wearable" refers only to the antenna. In other words, it is not necessary that a transceiver that is used in conjunction with the body wearable antenna is also body wearable. For example, a body wearable antenna may be operated with a portable, but non-body wearable, transceiver and signal processing means.

The terminology "portable antenna" is used herein to refer to antennas that may be easily or conveniently transported by a person. Thus, a body wearable antenna is more than merely a portable antenna. For example, a conventional 'whip-style' antenna, which may be carried by a person in a back-pack, is a portable antenna. However, since the conventional whip-antenna is not adapted to conform to the contours of the user's back, this type of antenna is not a body wearable antenna under the above definitions.

Figure 1:
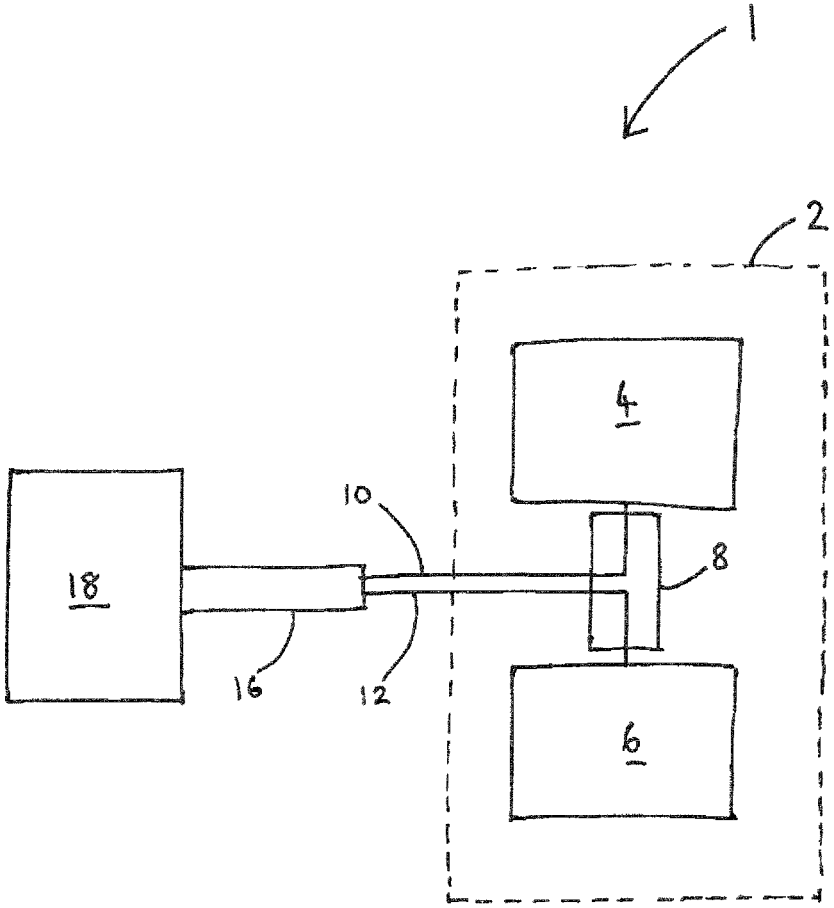
FIG. 1 is a schematic illustration of a body wearable communication system in which a first embodiment of a body wearable antenna is implemented.

FIG. 1 is a schematic illustration of a communication system 1 in which a first embodiment of a body wearable antenna 2 is implemented.

The communication system 1 comprises a body wearable antenna 2, and a radio transceiver 18. The body wearable antenna 2 is connected to the radio transceiver 18 using a twin conductor feedline, hereinafter referred to as the "feedline 16". The feedline 16 comprises two conductors, which are insulated from each other.

The body wearable antenna 2 comprises a leg band 4, and a radial portion 6. The leg band 4 is connected to the radial portion 6 via a connector 8. The leg band 4, the radial portion 6, and the connector 8 will be described in more detail later below with reference to FIG. 2.

The radio transceiver 18 is portable. The radio transceiver 18 is connected to the body wearable antenna 2 via the feedline 16. In this embodiment, the radio transceiver 18 is connected to the leg band 4 of the body wearable antenna 2 via a first conductor 10 of the feedline 16, and the radio transceiver 18 is connected to the radial portion 6 of the body wearable antenna 2 via a second conductor 12 of the coaxial cable. In this embodiment, the feedline 16 is coaxial cable. The first conductor 10 is the outer conductor of the coaxial cable. The second conductor 12 is the inner conductor of the coaxial cable.

In this embodiment, the connector 8 allows the first conductor 10 to connect to the leg band 4 of the body wearable antenna 2, and connects the second conductor 12 to the radial portion 6, whilst insulating the two conductors 10, 12 from each other.

Figure 2:
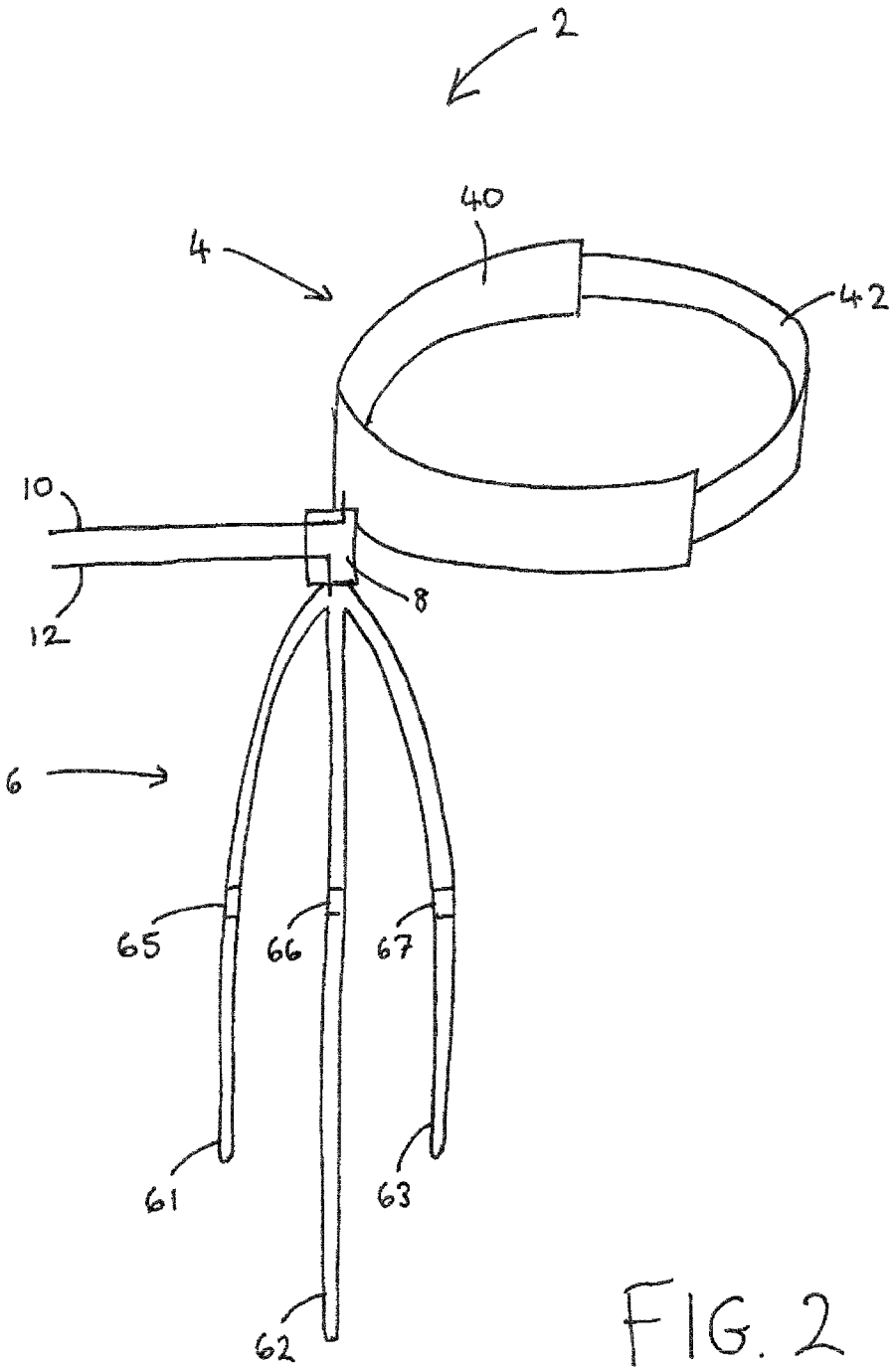
FIG. 2 is a perspective view of the body wearable antenna.

FIG. 2 is a perspective view of the body wearable antenna 2 shown in FIG. 1.

In this embodiment, the leg band 4 comprises a conductive element 40, and an adjustable strap 42. The conductive element is a U-shaped band made of metal. In this embodiment, the conductive element is made of insulated copper stranded wire. The conductive element 40 is U-shaped to fit around the thigh of a user. The first conductor 10 is connected to the conductive element 40. During use, the conductive element 40 of the leg band 4 acts as an antenna for received and/or transmitted radio frequency signals, as described in more detail later blow with reference to FIGS. 5 and 6.

In this embodiment, the adjustable strap 42 is used to strap the leg band 4 to the thigh of a user, as described in more detail later below with reference to FIGS. 3A and 3B.

In this embodiment, the connector 8 connects the feedline 16 to the leg band 4 and the radial portion 6. The connector 8 contains and insulator which ensures there is no direct conductive path between the two feedline conductors 10, 12 and also ensures there is no direct conductive path between the radial and leg band portions of the body wearable antenna 2. In this embodiment, the connector is made of copper with a PTFE insulator.

In this embodiment, the radial portion 6 comprises three conductive radial elements, or spokes. The three radial elements are hereinafter referred to as the first radial 61, the second radial 62, and the third radial 63. In this embodiment, the first, second, and third radials 61, 62, 63 are each made of a stiff metal wire. Each of the first, second, and third radials 61, 62, 63 has a first and second end.

In this embodiment, the first, second, and third radials 61, 62, 63 are joined to together at the first ends of the radials. The joined together first ends of the first, second and third radials 61, 62, 63 are joined to the connector 8. The connector joins the second conductor 12 to the joined together first ends of the first, second and third radials 61, 62, 63.

In this embodiment, the second ends of each of the first, second, and third radials 61, 62, 63 are "free ends". The radials 61, 62, 63 extend away from the connector 8 such that the second ends of each of the radials 61, 62, 63 are distal from the connector 8 and such that the second ends are not connected to any further element of the communication system 1.

In this embodiment, the first radial 61 and the third radial 63 are of substantially equal length. The second radial 62 is longer than the first and third radials 61, 63 and is positioned between the first and third radials 61, 63. The radials 61, 62, 63 are of a length such that when the body wearable antenna 2 is worn by a user, as described in more detail below with reference to FIGS. 3A and 3B, the radials 61, 62, 63 extend from the wearer's thigh (onto which the leg band 4 is strapped), down the length of the wearer's leg.

In this embodiment, the radials 61, 62, 63 extend away from the connector 8 obliquely to each other, i.e. at angles with respect to each other. Advantageously, the angles between the radial may be varied depending on the radio signal transmission/reception properties that are required of the body wearable antenna 2 by a user. By changing the angle between the radials 61, 62, 63, the range of frequencies which can be effectively received by the body wearable antenna 2 can be varied. In this embodiment, the angles between the radials 61, 62, 63 tend to be maintained by virtues of the rigidity of the radials 61, 62, 63 themselves, and the rigidity of the joint at the first ends of the radials 61, 62, 63. However, in other embodiments the angles between the radials 61, 62, 63 are maintained by different appropriate means. For example, in other embodiments rigid spacers made of insulating material may be implemented between the radials 61, 62, 63. In other embodiments the radials 61, 62, 63 may be directly attached to the clothing of a wearer by, for example, straps or Velcro™ on the clothing that keep the radials 61, 62, 63 in place. In other embodiments, the radials 61, 62, 63 may be integrated directly into the clothing of a user by, for example, by weaving a conductive material into clothing e.g. using silver loaded rip-stop nylon as clothing material.

In this embodiment, the first radial 61, the second radial 62, and the third radial 63 each comprises a hinge, hereinafter referred to as the "first hinge 65", the "second hinge 66", and the "third hinge 67" respectively. The first, second and third hinges 65, 66, 67 are positioned between the first and second ends of the first, second, and third radials 61, 62, 63 respectively, i.e. between the joined and free ends of the respective radials. The hinges 65, 66, 67 are positioned such that they allows a wearer of the body wearable antenna 2 to bend at the knee, as described in more detail later below with reference to FIG. 4.

In this embodiment, the conductive element 40 of the leg band 4, i.e. the U-shaped band made of metal, is substantially wider than the thickness of the radials 61, 62, 63. This advantageously provides a large grounded area to counterpoise the feed signal against the radial portion 6 of the antenna 2. This forms a non-symmetric antenna which does not require a balun (which is required by many conventional body wearable antennas). Thus, as a balun component is not required, the overall size and cost of the antenna tends to be lower than that of a conventional body-wearable antenna. Moreover, the maximum power output of a body wearable antenna tends to be reduced.

Figure 3A:
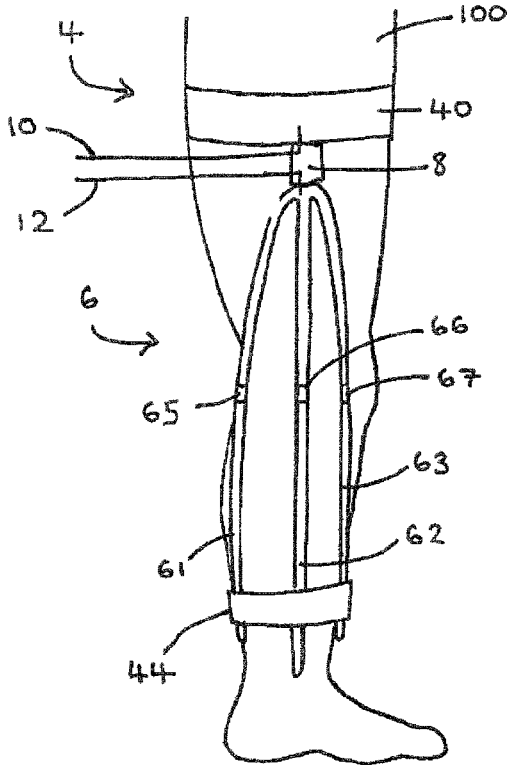
FIG. 3A is a schematic illustration of a side view of the body wearable antenna strapped to a leg.
Figure 3B:
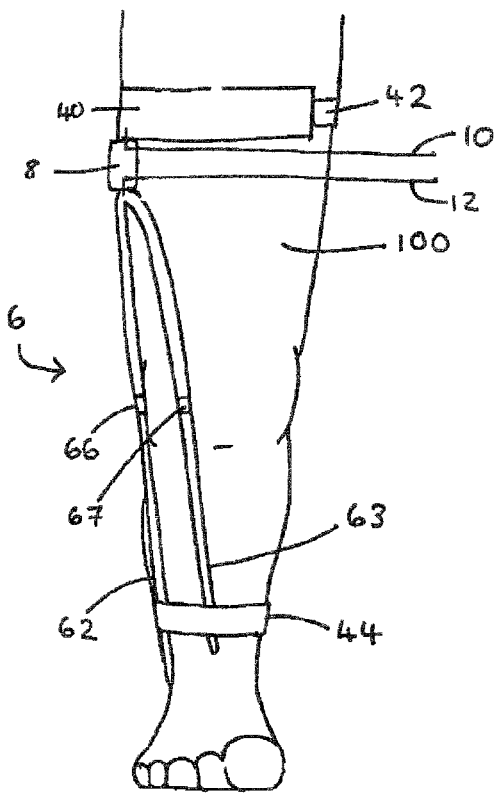
FIG. 3B is a schematic illustration of a front view of the body wearable antenna strapped a the leg.

FIGS. 3A and 3B are schematic illustrations of the body wearable communications system 1 being worn by a user.

In this embodiment, the body wearable antenna 2 is strapped to a leg 100 of the user. In this embodiment, the body wearable antenna 2 is worn on top of any clothing the user is wearing. This advantageously provides that the body wearable communications system 1 tends to be able to be easily removed from a user, e.g. for use by another user, quickly and/or without the need of removing clothing.

FIG. 3A is a schematic illustration of a side view of the body wearable antenna 2 strapped to the leg 100. FIG. 3B is a schematic illustration of a front view of the body wearable antenna 2 strapped to the leg 100.

The radio transceiver 18 (not shown in FIGS. 3A and 3B) is portable. For example, the radio transceiver 18 may be worn by the user at a location on the body, e.g. in a back-pack.

In this embodiment the body wearable antenna 2 is worn against the leg 100, and is attached to the thigh portion of the leg 100. The leg band 4 fits around the thigh of the leg 100 and is held in place using the adjustable strap 42.

The radial portion 6 is positioned such that the first, second, and third radials extend down the length of the leg 100. The radials 61, 62, 63 extend down the outer leg. Moreover, the second radial 62 extends down the outside of the leg 100, the first radial 61 extends down the outside of the leg 100 and extends away from the second radial 62 around the back of the leg 100, and the third radial 63 extends down the outside of the leg 100 and extends away from the second radial 62 around the front of the leg 100. Thus, the radials 61, 62, 63 extend down the outside of the leg 100 obliquely to one another.

Moreover, the radials 61, 62, 63 are positioned such that the hinges 65, 66, 67 are appropriately positioned to advantageously allow bending of the leg 100 at the knee, as described in more detail later below with reference to FIG. 4.

In this embodiment the radials are held against the body by a further adjustable strap 44. The further adjustable strap 44 ensures that the radials 61, 62, 63 are held against the leg, i.e. that they do not extend substantially away from the body.

Figure 4:
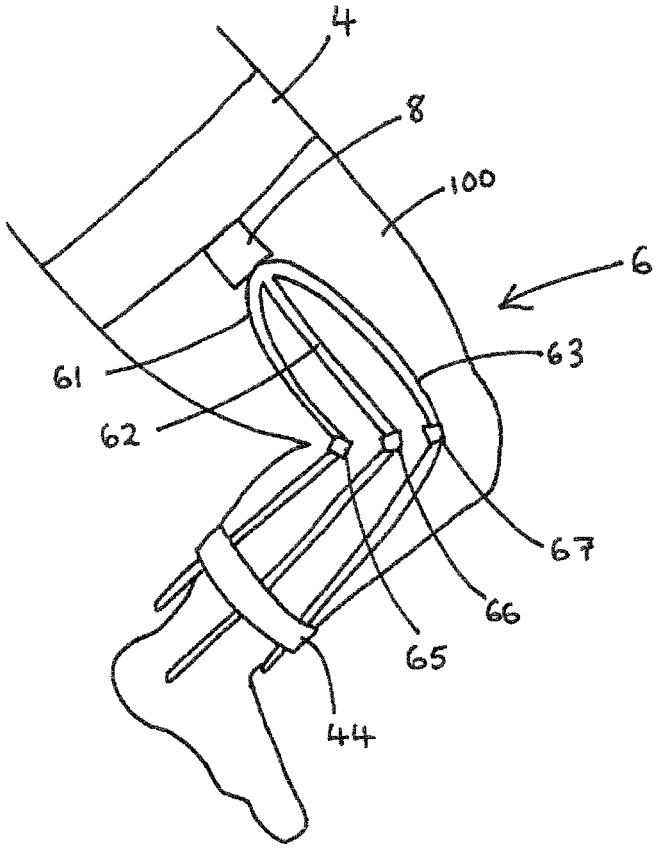
FIG. 4 is a schematic illustration of a side view of the body wearable antenna strapped to a leg which is in a bent position.

FIG. 4 is a schematic illustration of a side view of the body wearable antenna 2 strapped to the leg 100. The leg 100 shown in FIG. 4 is in a bent position, i.e. the leg 100 is bent at the knee. The first hinge 65 advantageously provides for rotation between the portions of the first radial 61 on either side of the first hinge 65. Similarly, the second hinge 66 advantageously provides for rotation between the portions of the second radial 62 on either side of the second hinge 62. Similarly, the third hinge 67 advantageously provides for rotation between the portions of the third radial 63 on either side of the third hinge 63. The hinges 65, 66, 67 are positioned on their respective radials proximate to the knee joint of the leg 100. Thus, the hinges 65, 66, 67 advantageously allow a user to move freely when wearing the body wearable antenna 2.

Moreover, the hinges 65, 66, 67 advantageously allow a user to move freely without detrimentally affecting the performance of the antenna. Movement of the body may cause slight detuning effects, but, due to the body wearable antenna 2 being wideband, this tends not to be detrimental to the performance of the antenna.

The advantage of allowing a user to move freely may also be provided by other embodiments. For example, forming the radials 61, 62, 63 by weaving a conductive material into clothing allows a user to move freely.

Thus, a body wearable communication system 1 comprising a body wearable antenna 2 is provided. Example operations of the body wearable communications system 1 will be described later below with reference to FIGS. 5 and 6.

Figure 5:
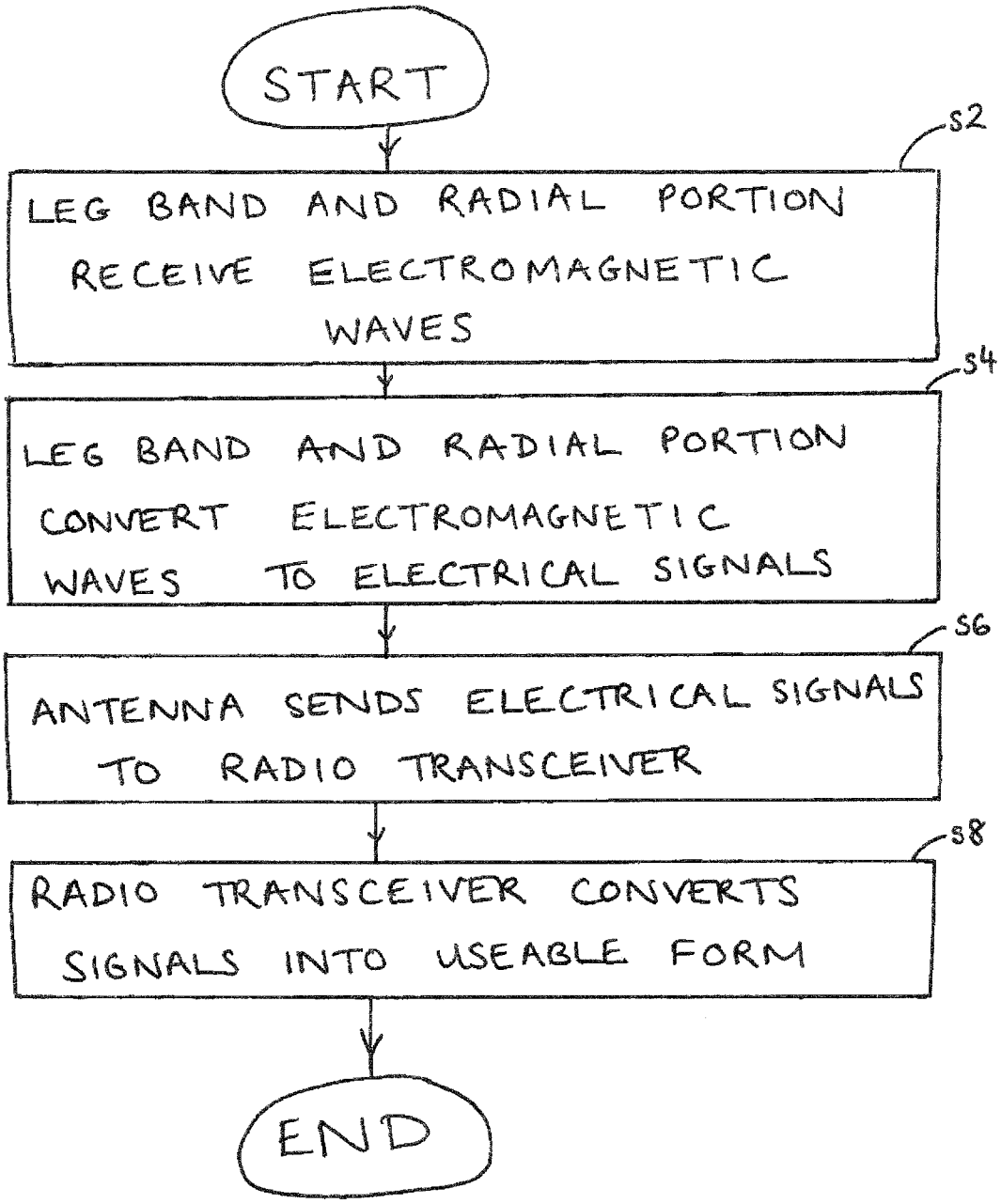
FIG. 5 is a process flow chart of an example operation of the body wearable communication system in which the body wearable antenna receives radio frequency signals.

FIG. 5 is a process flow chart of an example operation of the body wearable communication system 1. In this example operation, the body wearable antenna 2 receives radio frequency signals.

At step s2, the leg band 4 and the radial portion 6 of the body wearable antenna 2 receive electromagnetic waves.

A step s4, the electromagnetic waves are converted into electrical signals in a conventional manner.

At step s6, the leg band 4 and the radial portion 6 send the electrical signals to the radio transceiver 18 via the coaxial cable 16.

In this embodiment, the feedline 16 is a conventional coaxial cable, i.e. an electrical cable comprising two conductors: an inner conductor and a surrounding conductive layer (i.e. an outer conductor) which is separated from the inner conductor by an insulating layer. In this example operation, the signal corresponding to the leg band 4 is sent from the leg band 4 to the radio transceiver 18 via the outer conductor, i.e. the first conductor 10 of the feedline 16. Also, the signal corresponding to the radial portion 6 is sent from the radial portion 6 to the radio transceiver 18 via the surrounding outer conductive layer (i.e. the second conductor 12) of the feedline 16.

At step s8, the radio transceiver 18 converts the received signals into a form that is useable by a user of the body wearable communication system 1. For example, the radio transceiver converts the received electrical signals into an audio signal that a wearer of the body wearable communication system 1 can hear.

Figure 6:
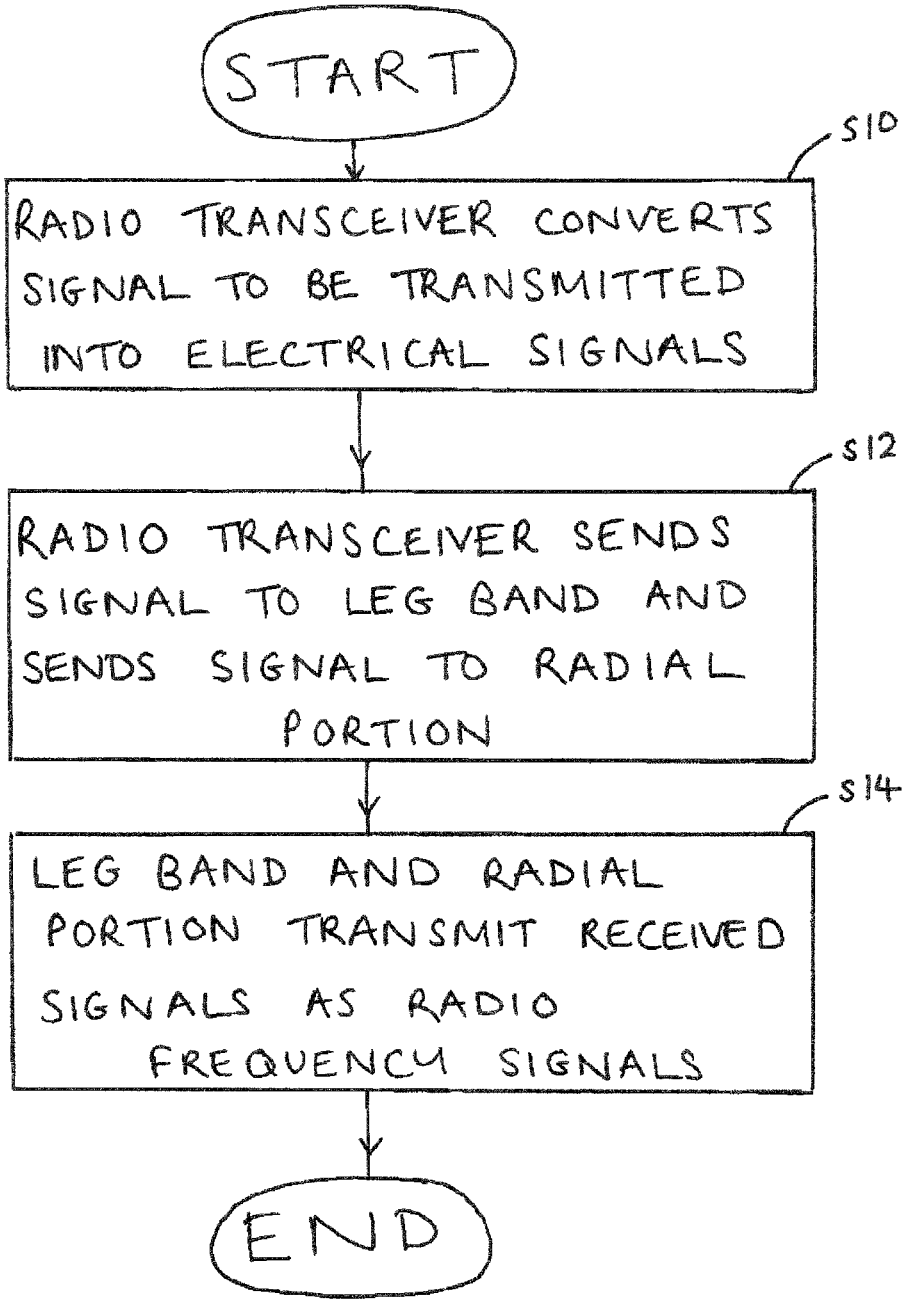
FIG. 6 is a process flow chart of a further example operation of the body wearable communication system in which the body wearable antenna transmits radio frequency signals.

FIG. 6 is a process flow chart of a further example operation of the body wearable communication system 1. In this example operation, the body wearable antenna 2 transmits radio frequency signals.

At step s10, the radio transceiver 18 converts a user signal that is to be transmitted by the body wearable communication system 1 into electrical signals. For example, the radio transceiver converts spoken information that is spoken by a wearer of the body wearable communication system 1 in to electrical signals.

At step s12, the radio transceiver 18 sends the electrical signals to the leg band 4 and the radial portion 6 of the body wearable antenna 2 via the coaxial cable 16 in a manner corresponding to that described above at step s6, with reference to FIG. 5. In other words, the radio transceiver 18 sends an electrical signal via the first conductor 10 of the feedline 16 to the leg band 4, and an electrical signal via the surrounding conductive layer (i.e. the second conductor 12) of the feedline 16 to the radial portion 6.

At step s14, the electrical signals received by the leg band 4 and radial portion 6 of the body wearable antenna 2 are converted to radio frequency signals and transmitted by the leg band 4 and the radial portion respectively.

An advantage provided by the above described body wearable antenna 2 is that is the antenna tends to be wideband, i.e. the antenna has substantially similar operating characteristics over a very wide passband.

This wideband feature advantageously tends to allow for less detuning due to body movement or proximity of the body wearable antenna to other objects.

The wideband feature further advantageously allows for the body wearable antenna 2 to be suitable for use in a cognitive radio system, i.e. systems in which a wavelength of radio signals used for communication is chosen to avoid interference with other users.

The above described body wearable antenna 2 advantageously tends to alleviate or avoid problems caused by detuning effects which may arise, for example, as a result of body movement.

A further advantage provided by the above described body wearable antenna 2 is that the antenna tends to be wearable without extending beyond the body of a wearer to any significant degree. This tends to be in contrast to conventional portable antennas, e.g. back-pack whip antennas. This feature advantageously tends to provided increased maneuverability for a user. Also, the body wearable antenna tends to be more discrete and is less likely to be damaged during use.

A further advantage of the above described body wearable antenna 2 is that it is portable.

The feature that the above described body wearable antenna 2 is adapted to fit against a leg 100 of a wearer advantageously exploits the size and shape of the wearer's leg 100. Wearing the body wearable antenna 2 on the leg 100 tends to provide that that the radial portion 6 of the body wearable antenna 2 is able to extend substantially down the complete length of the leg 100. This length of the radial portion tends to provide that the body wearable antenna 2 operates at a low frequency.

The wearer's leg 100 is typically roughly cylindrical in shape. When the radial portion 6 of the body wearable antenna 2 is worn against the leg the second radial 62 extends down the outside of the leg 100. Also, the first radial 61 extends down the outside of the leg 100 and extends away from the second radial 62 around the back of the leg 100. Also, the third radial 63 extends down the outside of the leg 100 and extends away from the second radial 62 around the front of the leg 100. Thus, the configuration of the radials 61, 62, 63 is such that each radial can be considered to lie on a cone. The circumference of the base of the cone encircles the leg 100, and the vertex of the cone lies at a point of the surface of the leg 100, i.e. where the three radials 61, 62, 63 are joined together. Thus, the body wearable antenna 2 benefits from the advantages of a conventional discone antenna, for example the body wearable antenna 2 is a wide-band antenna.

A further advantage of the body wearable antenna 2 being capable of being worn on the leg, as opposed to other areas of a user, is that the antenna 2 does not impinge on the wearing of other apparatus in these other areas. For example, a soldier is able to wear the body wearable antenna 2 on his/her leg without impacting on the soldier's ability to wear armour or carry ammunition on the soldier's torso.

In the above embodiments, the body wearable antenna is worn on the leg of a user, with the leg band 4 worn in effect substantially round the leg and the radial portion 6 worn in effect substantially along the leg. However, in other embodiments the leg band may be replaced by a corresponding part shaped to fit around a user's waist, such that the band part is worn around the waist and the radial portion is worn such as to extend down the leg from the waist. In other embodiments the body wearable antenna is worn on any other appropriate body part. For example, in another embodiment the body wearable antenna may be worn against an arm by adapting the leg band 4 to attach to a user's upper arm, and by adapting the radials to extend down the length of the user's arm towards to wrist. The radials may be hinged at or near the user's elbow to allow free movement of the user.

In the above embodiments, a single body wearable antenna is worn by a user. However, in other embodiments more than one body wearable antenna is worn. For example, in other embodiments a user may wear a body wearable antenna on each leg. This advantageously tends to provide better coverage in different directions by the communication system 1.

In the above embodiments, the leg band comprises a conductive element which is a band adapted to fit around the thigh area of a leg. However, in other embodiments the conductive element may be any appropriate shape.

In the above embodiments, each radial comprises a single hinge. However, in other embodiments any number of radials may comprises any number of hinges or other means of allowing for the free movement of a user.

In the above embodiments, the body wearable antenna is strapped on to the body (using the adjustable strap and further adjustable strap as described above with reference to FIGS. 3A and 3B). However, in other embodiments the body wearable antenna is attached to the body using any appropriate means. For example, the antenna may be integrated into the clothing of a user.

In the above embodiments, the radial portion comprises three radial elements. However, in other embodiments the radial portion comprises any number of radial elements.

In the above embodiments, the first and third radials are substantially equal in length and the second radial is substantially longer than the other two. However, in other embodiments the relative sizes of the radials is different to those in the above embodiments. For example, in other embodiments the radials are all of substantially equal size.

In the above embodiments, a radial element, i.e. the second radial element, extends down substantially the whole length of the outside of the leg of a user. However, in other embodiments any number of radials extends down substantially the length of the whole leg of the user. Also, in other embodiments any number of radials extends only partially down the length of the leg of a user.

In the above embodiments, it is not necessary to balance the feeds of the leg band and the radial portion. Hence, in the above embodiments a balun is not used. However, in other embodiments the feeds to the body wearable antenna are balanced. For example, in other embodiments a balun is implemented.

In the above embodiments, the body wearable antenna is worn externally of the user's clothing. However, in other embodiments the body wearable antenna is worn underneath clothing, or the body wearable antenna is integrated in to the clothing of a user. Such implementation advantageously tends to provide that the body wearable antenna is more discrete than in embodiments in which the antenna is worn externally of clothing.

The invention claimed is:

1. A body wearable antenna adapted to be worn against the body comprising:

a first antenna part adapted to be worn circumferentially around a body part; and a second antenna part insulated from the first antenna part, the second antenna part being adapted to be worn longitudinally against a body part, the second antenna part comprising a plurality of radial elements, arranged such that each radial element extends away from the first antenna part.

2. A body wearable antenna according to claim 1, wherein the body part that the first antenna part is adapted to be worn circumferentially around and the body part that the second antenna part is adapted to be worn longitudinally against are different body parts.

3. A body wearable antenna according to claim 1, wherein the body part that the first antenna part is adapted to be worn circumferentially around and the body part that the second antenna part is adapted to be worn longitudinally against are the same body part.

4. A body wearable antenna according to claim 1, wherein the second antenna part extends circumferentially around the body part to some extent.

5. A body wearable antenna according to claim 1, wherein at least a part of the second antenna part extends along substantially the whole length of the body part.

6. A body wearable antenna according to claim 1, wherein each of the plurality of radial elements is oblique with respect to another of the plurality of radial elements.

7. A body wearable antenna according to claim 1, wherein the second antenna part comprises three radial elements.

8. A body wearable antenna according to claim 7, wherein:

a first of the three radial elements extends around a first side of the body part;

a second of the three radial elements extends around a second side of the body part; and the first side is opposite the second side.

9. A body wearable antenna according to claim 1, wherein one or more radial elements each comprise one or more hinges.

10. A body wearable antenna according to claim 1, wherein the first antenna part is a band of material.

11. A body wearable antenna according to claim 1, wherein one or both of the body parts is a leg of a user.

12. A body wearable antenna according to claim 1, wherein the body wearable antenna is adapted to be worn on top of a user's clothes.

13. A communications system comprising:

a body wearable antenna adapted to be worn against the body comprising: a first antenna part adapted to be worn circumferentially around a body part; and a second antenna part insulated from the first antenna part, the second antenna part being adapted to be worn longitudinally against a body part, the second antenna part comprising a plurality of radial elements, arranged such that each radial element extends away from the first antenna part;

a radio transceiver adapted to send and receive signals via the body wearable antenna; and a connector arranged to connect the body wearable antenna to the radio transceiver.

14. A communications system according to claim 13 wherein the radio transceiver is portable.

* * * * *